US008453734B2

(12) United States Patent
Jasek et al.

(10) Patent No.: US 8,453,734 B2
(45) Date of Patent: Jun. 4, 2013

(54) SHUNT ISOLATION VALVE

(75) Inventors: Sidney Jasek, Pearland, TX (US); Kamalah Chang, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 516 days.

(21) Appl. No.: 12/751,521

(22) Filed: Mar. 31, 2010

(65) Prior Publication Data

US 2011/0240290 A1 Oct. 6, 2011

(51) Int. Cl.
*E21B 43/04* (2006.01)

(52) U.S. Cl.
USPC ..... 166/278; 166/51; 166/332.1

(58) Field of Classification Search
USPC ..... 166/332.1, 334.1, 51, 183, 278
See application file for complete search history.

(56) References Cited

U.S. PATENT DOCUMENTS 6,298,916 B1 10/2001 Tibbles et al.
7,243,723 B2 7/2007 Surjaatmadja et al.
2005/0061501 A1 3/2005 Ward et al.
2007/0044962 A1 3/2007 Tibbles
2008/0296019 A1* 12/2008 Johnson et al. ..... 166/278

OTHER PUBLICATIONS

PCT/US2011/027052—International Application Filed on Mar. 3, 2011—International Search Report dated Aug. 26, 2011.

* cited by examiner

*Primary Examiner* — Kenneth L Thompson
*Assistant Examiner* — Taras P Bemko
(74) *Attorney, Agent, or Firm* — David G. Matthews; Brandon Clark; Robb D. Edmonds

(57) ABSTRACT

Gravel packing apparatus and method. The apparatus can include a conduit configured to extend between first and second wellbore intervals and through an isolation valve assembly separating the first and second intervals. A sliding sleeve can be configured to slide between an open position and a closed position. When the sliding sleeve is in the open position, it is configured to allow a flow of gravel slurry through the conduit between the first and second intervals, and when the sliding sleeve is in the closed position, it is configured to completely isolate the first and second intervals from each other.

6 Claims, 4 Drawing Sheets

SHUNT ISOLATION VALVE

BACKGROUND

Various methods and devices for reducing or eliminating sand and other particulate production from a formation during wellbore completion are known. Gravel packing of the formation is one such method and generally involves placing a sand screen around a section of the production string or tubing containing production inlets, with the section of the production string being aligned with wellbore perforations into adjacent formations. Gravel is then mixed with a viscous carrier fluid to form a gravel slurry and sent into intervals adjacent the formation. The gravel slurry deposits the gravel in the intervals, and the remaining carrier fluid is typically recirculated to the surface.

The formation of gravel bridges is a problem often associated with gravel packing. Gravel bridges form when the gravel slurry dehydrates, forming obstructions in the wellbore, which can cause voids to be created. This can be detrimental to the wellbore completion; however, the drawbacks of gravel bridges can be avoided in various ways, such as by including shunt tubes extending through the intervals in the wellbore completion.

The shunt tubes can provide an alternative flow path around any gravel bridges and can connect together via conduits disposed through a wellbore packer, creating a flow path between adjacent, but separated, intervals. However, after gravel packing is complete, the shunt tubes may remain in communication with multiple intervals in the wellbore, which may allow undesired commingling of formation fluids between the intervals. Various methods and systems have been employed to reduce the particulate communication between intervals during production, but there is still a need for an effective sealable fluid barrier that isolates adjacent intervals, despite the presence of shunt tubes.

SUMMARY

Embodiments of the disclosure provide an illustrative wellbore completion apparatus. The wellbore completion apparatus can include a conduit configured to extend between first and second wellbore intervals and through an isolation valve assembly separating the first and second intervals, and a sliding sleeve configured to slide between an open position and a closed position, wherein the sliding sleeve in the open position is configured to allow a flow of gravel slurry through the conduit between the first and second intervals, and the sliding sleeve in the closed position is configured to completely isolate the first and second intervals from each other.

Embodiments of the disclosure further provide an illustrative method for gravel packing a wellbore. The method includes gravel packing a first wellbore annulus between a production tubing and a formation with gravel from a gravel slurry, the first wellbore annulus at least partially bounded by an isolation valve assembly, and channeling the gravel slurry through a conduit formed in the isolation valve assembly, through a window defined in a slidable sleeve disposed in the isolation valve assembly, and into a second wellbore annulus disposed between the production tubing and the formation. The method also includes gravel packing the second wellbore annulus with gravel from the gravel slurry, and completely isolating the first wellbore annulus from the second wellbore annulus by sealing the conduit by sliding the slidable sleeve to obstruct the conduit.

Embodiments of the disclosure additionally provide an illustrative apparatus for gravel packing. The apparatus includes first and second shunt tubes, and an isolation valve assembly defining a conduit having a first side coupled to the first shunt tube and a second side coupled to the second shunt tube, and a cavity having a length and intersecting with the conduit at an intersection. The apparatus also includes a sliding sleeve including a body having a length that is shorter than the length of the cavity, the body defining an aperture therein, wherein the body is disposed at least partially in the cavity such that the sliding sleeve slides from an open position in which the aperture is aligned with the intersection of the cavity and the conduit to allow fluid communication through the conduit, and a closed position in which the body spans the intersection between the cavity and the conduit to sealingly obstruct the conduit.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1A:
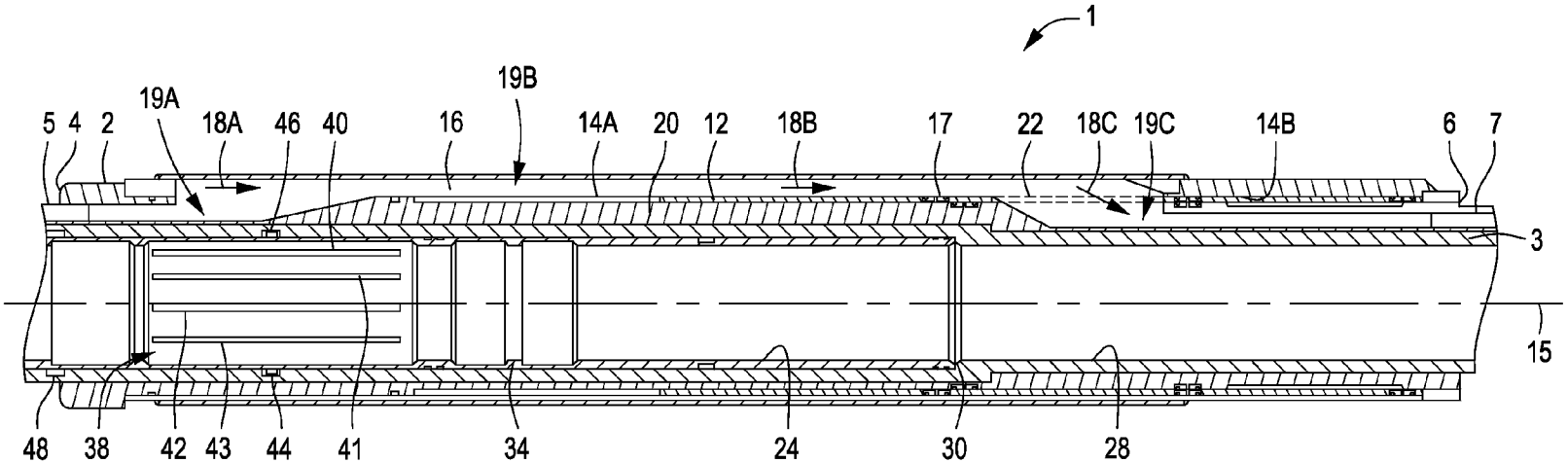
FIG. 1A depicts a partial cross-sectional view of an illustrative isolation valve assembly with a sliding sleeve in an open position, according to one or more embodiments described.

FIG. 1A depicts an illustrative isolation valve assembly 1, for use in isolating regions of a wellbore completion, according to one or more embodiments. The isolation valve assembly 1 can be disposed in a packer assembly 2, between sections of production tubing 3. The packer assembly 2 can be connected on a first side 4 with a first or "upper" shunt tube 5, and on a second side 6 with a second or "lower" shunt tube 7. In various embodiments, the isolation valve assembly 1 and/or the packer assembly 2 can be substantially symmetric about a central axis 15 to provide a generally cylindrically-shaped device.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same can be equally effective in either horizontal or vertical wellbore uses.

The isolation valve assembly 1 can further include a sliding sleeve 12, which can be movable between an open position, as shown in FIG. 1A, and a closed position, which is shown and described below with reference to FIG. 1B. In the open position, the sliding sleeve 12 can allow a flow of gravel slurry, indicated by arrows 18A, 18B, and 18C, to flow through a side conduit 16 defined in and extending through the packer assembly 2. Accordingly, when the sliding sleeve 12 is open, the side conduit 16 can provide for fluid communication between the upper and lower shunt tubes 5, 7. It will be appreciated that the side conduit 16 can be an annulus that extends circumferentially around the packer assembly 2, or any one or more tubular members or bores of any shape.

In one or more embodiments, the packer assembly 2 can include a housing 20 into which the side conduit 16 is defined and in which first and second cavities 14A, 14B are defined. The side conduit 16 can include first and second angled portions 19A, 19C, with a central portion 19B extending between and connected to the two angled portions 19A, 19C. The central portion 19B can extend substantially parallel to the central axis 15, while the two angled portions 19A, 19C, can extend at, for example, reciprocal angles relative to the central axis 15. The cavities 14A, 14B may be aligned on either side of the side conduit 16 such that the cavities 14A, 14B intersect the side conduit 16 and open to the side conduit 16. In one or more embodiments, the cavities 14A, 14B can open to and intersect with the second angled portion 19C. Furthermore, the cavities 14A, 14B may define an area in the housing 20 that is larger, for example, longer, than the sliding sleeve 12, thus allowing the sliding sleeve 12 to be slidably disposed therein. The cavities 14A, 14B can also include sealing elements, such as sealing element 17, which can be or include one or more O-rings and the like, to create a sealed slidable engagement between the walls of the cavities 14A, 14B and the sliding sleeve 12, thereby avoiding the ingress of any fouling or wear-promoting particulate matter or fluids. Although two cavities 14A, 14B are described, it will be appreciated that first and second cavities 14A, 14B may instead be a single cavity extending through the housing 20 and intersecting the side conduit 16, or may include additional cavities.

The sliding sleeve 12 can be or include a generally solid body made of any suitably rigid material, such as metals, alloys, ceramics, or polymers, and can have an aperture or window 22 defined therein. The window 22 being defined in and/or through the solid body of the sliding sleeve 12, and can thus be surrounded thereby, such that the sliding sleeve 12 is one continuous member. However, in various other embodiments, the sliding sleeve 12 can include multiple rigid parts that are fixed or attached together about the window 22. In one or more embodiments, when the sliding sleeve 12 is in the open position, the window 22 can be aligned with the second portion 19C of side conduit 16, for example, between the first and second cavities 14A, 14B, thus allowing gravel slurry and/or other fluids to proceed through the packer assembly 2. In other embodiments, the sliding sleeve 12 can include a plurality of windows 22, which can be aligned with multiple portions of the side conduit 16.

Figure 1B:
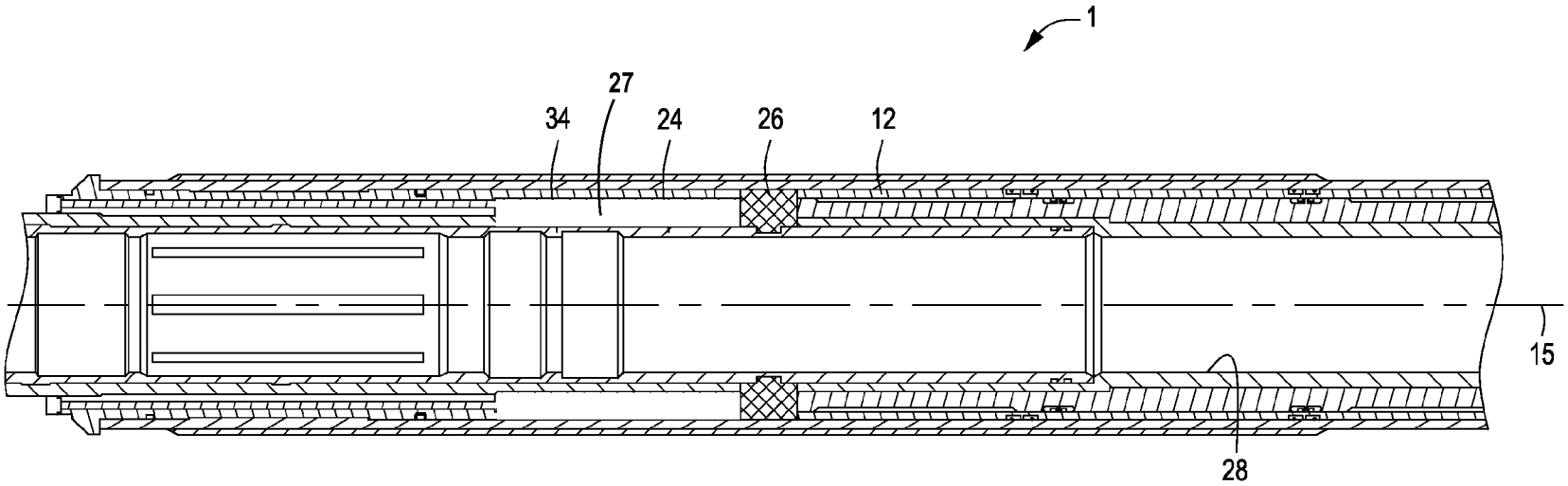
FIG. 1B depicts a rotated partial-cross sectional view of the illustrative isolation valve assembly of FIG. 1A, according to one or more embodiments described.

FIG. 1B depicts a rotated view of the illustrative isolation valve assembly 1, according to one or more embodiments. The sliding sleeve 12 can be connected to an internal sleeve 24, for example, by a translation key 26, which can extend partially or completely through the housing 20. The translation key 26 can be a pin fastened on either side to the sliding sleeve 12 and the internal sleeve 24, and disposed in a slot 27 extending generally parallel to the central axis 15, which allows movement of the translation key 26 along with the sleeves 12, 24. In various embodiments, the translation key 26 can also or instead include a metal piece welded or otherwise attached to both sleeves 12, 24, and/or the translation key 26 can be geared to effect unequal relative movement between the sliding sleeve 12 and the internal sleeve 24. Further, the translation key 26 can include a locking ratchet to prevent unintended reverse movement, such as that described in U.S. Pat. No. 6,298,916, the entirety of which is incorporated herein by reference to the extent not inconsistent with this disclosure.

Referring again to FIG. 1A, the internal sleeve 24 can be shiftably positioned in an inner bore 28 of the packer assembly 2. For example, the inner sleeve 24 can be positioned in the inner bore 28 such that it engages a shoulder 30 thereof when in the open position, which are spaced axially apart and can provide end ranges for the movement of the inner sleeve 24. The internal sleeve 24 can also include a latch profile 34, which can be, for example, an inwardly-extending collar. In various embodiments, the latch profile 34 can include additional collars, and can extend partly or completely around the central axis 15.

In one or more embodiments, the latch profile 34 can be bi-directional. For example, the latch profile 34 can engage any valve shifting tools (not shown) in either direction (e.g., left-to-right, or right-to-left, as shown). Accordingly, the internal sleeve 24 can be shifted away from, or back toward, the first shoulder 30, allowing for selective opening and closing of the fluid control device 1. Furthermore, the latch profile 34 can be configured to releaseably engage any valve actuation tools, allowing for multiple fluid control devices 1 in a given wellbore completion. This can be achieved by constructing the latch profile 34 such that it can deform away from the valve shifting tool. Illustrative latch profiles 34 can include a spring mechanism (not shown) disposed in the latch profile 34, forming the latch profile 34 out of a compliant material, such as an elastomer, tapering or otherwise shaping or forming the latch profile 34 such that a sufficient force on the valve actuator can overcome the latch profile 34 either destructively or non-destructively, and/or the like.

The internal sleeve 24 can also include a collet region 38. The collet region 38 can have an increased diameter and a plurality of slits, for example, slits 40, 41, 42, 43 formed therein. The internal sleeve 24 can also include a detent 44 disposed partially or completely around the collet region 38. The inner bore 28 of the packer assembly 2 can include first and second notches 46, 48, which can be sized to receive the detent 44. The collet region 38 can resiliently bias the internal sleeve 24 toward the inner bore 28, thereby biasing the detent 44 into the first or second notch 46, 48 to provide a resistance fit for the internal sleeve 24. The resistance fit can maintain the position of the internal sleeve 24 and thus the sliding sleeve 12 to which it connects. The collet region 38 can also allow an amount of elastic deformation inward, for example, when the internal sleeve 24 is shifted. This can allow the detent 44 to move out of the first or second notch 46, 48, enabling the shifting movement of the internal sleeve 24, and thus the sliding of the sliding sleeve 12 to which it is attached.

Figure 2:
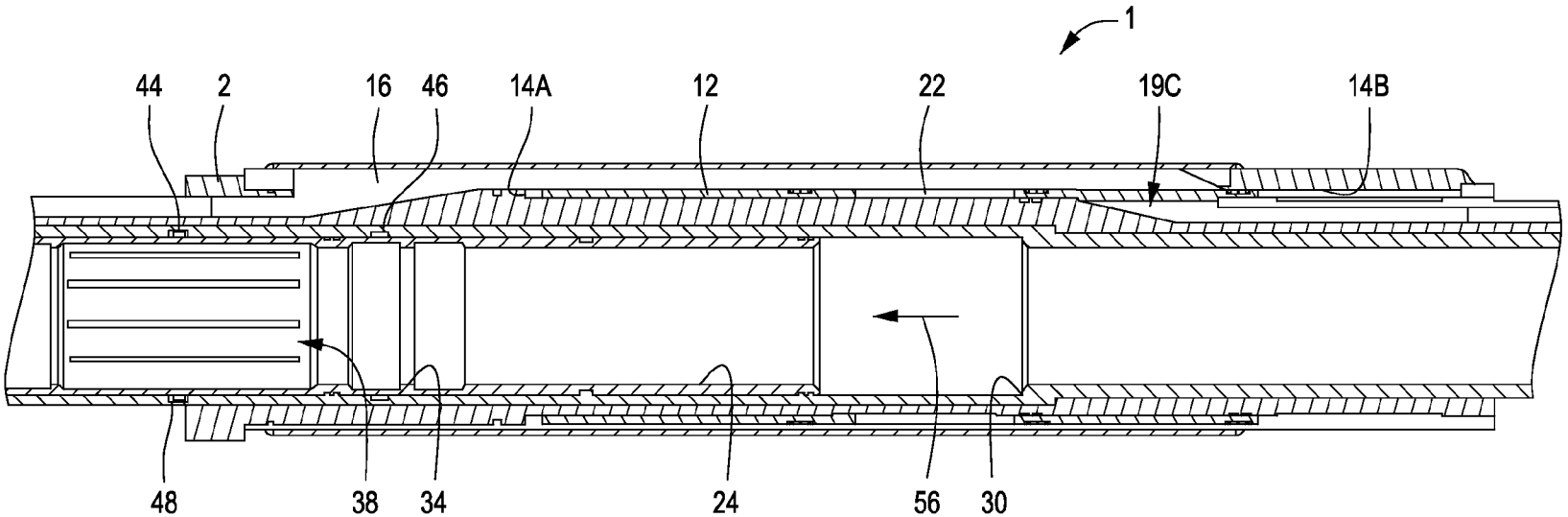
FIG. 2 depicts a partial cross-sectional view of the illustrative isolation valve assembly of FIG. 1A, with the sliding sleeve in a closed position, according to one or more embodiments described.

FIG. 2 depicts an illustrative embodiment of the isolation valve assembly 1, with the sliding sleeve 12 moved into a closed position, according to one or more embodiments. A force can be applied on the internal sleeve 24, for example, using a valve shifting tool (not shown) as is known in the art, to shift the internal sleeve 24 away from the shoulder 30 and in the direction of arrow 56. When this force is applied, the detent 44 can be pushed out of the notch 46 as the collet region 38 compliantly deforms in response, thereby allowing the detent 44 to completely slide out of the first notch 46. Once reaching the closed position, the internal sleeve 24 can reach an end range, where the detent 44 is received into the second notch 48. The isolation valve assembly 1 can include any additional locking member as necessary or desired to more securely maintain the position of the internal sleeve 24.

In one or more embodiments, shifting the internal sleeve 24 can cause the sliding sleeve 12 to slide by a proportional amount in the cavities 14A, 14B, since the internal sleeve 24 can be coupled to the sliding sleeve 12. This can move the window 22 into the first cavity 14A, such that the first cavity 14A surrounds the window 22, while a portion of the sliding sleeve 12 remains in the second cavity 14B. Accordingly, when in the closed position, the solid body of the sliding sleeve 12 can span the second portion 19C of the side conduit 16, thereby blocking the side conduit 16 and substantially prohibiting the flow of gravel slurry, production fluids, or other fluids therethrough.

As discussed above, the cavities 14A, 14B and/or the sliding sleeve 12 can include one or more sealing elements 17, such as O-rings. Thus, in the closed position, the sliding sleeve 12 can substantially seal the side conduit 16 closed, prohibiting the flow through the side conduit 16 more effectively than with other isolation valve assemblies, such as barrel valves (not shown). For example, the isolation valve assembly 1 can allow less than about 1 barrel, less than about 0.5 barrels, less than about 0.25 barrels, or less than about 0.1 barrels of fluid through the side conduit 16 per day. In various illustrative embodiments, the isolation valve assembly 1 can be configured to allow no fluid to pass.

Figure 3:
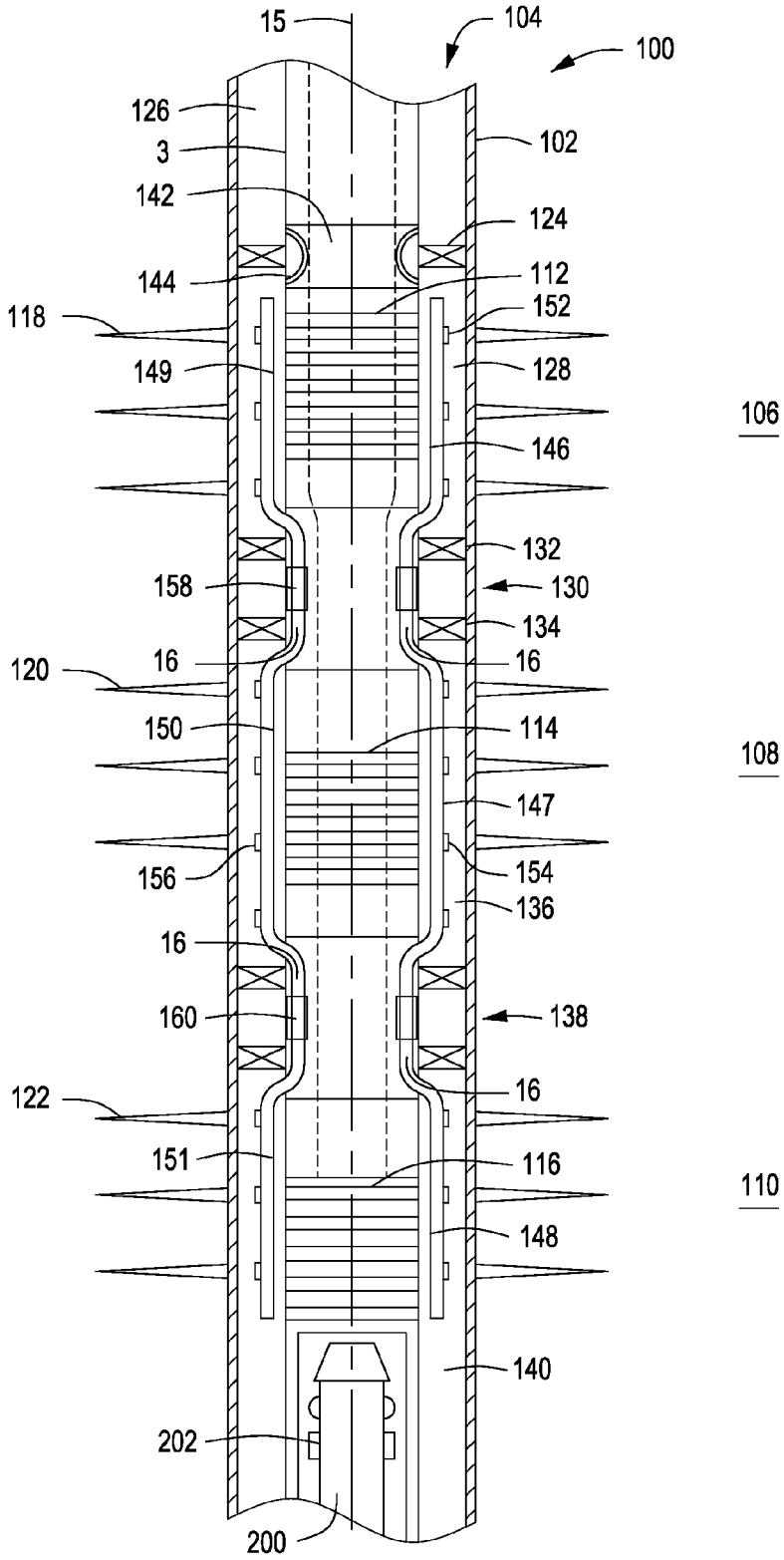
FIG. 3 depicts a cross-sectional view of a portion of an illustrative wellbore completion including an illustrative isolation valve assembly, according to one or more embodiments described.

FIG. 3 depicts a cross-sectional view of a portion of an illustrative wellbore completion 100. The wellbore completion 100 can generally include a casing 102 with a central axis that is substantially collinear to the central axis 15. The casing 102 and the production tubing 3 can be positioned in a wellbore 104, which can be any type of wellbore such as a vertical, horizontal, or deviated wellbore. The wellbore 104 can extend through a plurality of subterranean formation zones 106, 108, 110, which, in one or more embodiments, can be hydrocarbon-producing zones. In various embodiments, a larger or a smaller number of zones may be present in the wellbore 104. Sand control devices 112, 114, 116 may extend around the production tubing 3 and may each be positioned in the proximity of one or more of the formation zones 106, 108, 110, respectively. Each of the sand control devices 112, 114, 116 can include a screen having perforations, slits, or holes (not shown) through which fluids may diffuse. The sand control devices 112, 114, 116 can control the ingress of sand and other particulates into the production tubing 3 through perforations 118, 120, 122 in the formation zones 106, 108, 110, respectively. The perforations 118, 120, 122 may be created by any fracturing technique known in the art.

The wellbore completion 100 may also include a top packer 124 disposed between the casing 102 and the production tubing 3. It will be appreciated that, although not shown, additional packers may be included and positioned "above" the top packer 124 (i.e., between the top packer 124 and the surface). The top packer 124, as well as the other packers defined herein, can be any type of packer known to seal a wellbore annulus, including swellable packers, cup packers, and the like. The top packer 124 may separate or isolate an upper annulus 126 from a first interval 128, where both the upper annulus 126 and the first interval 128 may be wellbore annuli formed between the production tubing 3 and the casing 102.

The wellbore completion 100 can also include a first packer assembly 130, which can be connected to the production tubing 3. For example, the first packer assembly 130 can be connected to ends of the production tubing 3, thereby segmenting the production tubing 3. The first packer assembly 130 can include second and third packers 132, 134. The second and third packers 132, 134 can separate or isolate the first interval 128 from a second interval 136 defined between the casing 102 and the production tubing 3. Similarly, a second packer assembly 138 can separate the second interval 136 from a third interval 140, also defined between the casing 102 and the production tubing 3. It will be appreciated that any number of packer assemblies may be employed according to the number of formations, and that any number of packers may be included in each packer assembly 130, 138.

The wellbore completion 100 can also include a crossover 142. The crossover 142 can be disposed inside the production tubing 3 and can be aligned in the wellbore completion 100 with the top packer 124. The crossover 142 can communicate with the upper annulus 126 and the first interval 128 via a line 144, such that gravel slurry deployed into the upper annulus 126 can flow through the line 144, around the top packer 124, and into the first interval 128.

The wellbore completion 100 can further include one or more shunt tubes, for example, shunt tubes 146-151. The shunt tubes 146-151 can extend in the wellbore completion 100 generally parallel to the central axis 15. In one or more embodiments, the shunt tubes 146, 147, 149, 150 can provide a portion of a flow path for the gravel slurry between the first and second intervals 128, 136. To complete the flow path, the first packer assembly 130 can include the isolation valve assembly 1, shown in and described above with reference to FIGS. 1A-2, and accordingly, side conduits 16 can be connected to the shunt tubes 146, 147, 149, 150 for gravel slurry flow therethrough. For example, referring back to FIG. 1A, the shunt tubes 146, 149 can each provide the upper shunt tube 5, and the shunt tube 147, 150 can each provide the lower shunt tube 7.

The shunt tube 146 can include openings 152 located in the first interval 128, and the shunt tube 147 can include openings 154 located in the second interval 136. The openings 152, 154 can be slits, holes, or the like, and can communicate amongst themselves via the shunt tubes 146, 147. In one or more embodiments, if the gravel slurry encounters an obstruction between openings 152, the gravel slurry can enter the opening 152 above the obstruction and exit the opening 152 below the obstruction, thereby avoiding the described problems associated with gravel bridges. Openings 154 in the shunt tube 147 can perform the same function in the second interval 136. As such, the shunt tubes 146, 147 can provide an alternative flow path for gravel slurry around any unintended wellbore obstruction such as a gravel bridge. Further, the shunt tubes 146, 147 can provide a flow path for the gravel slurry through the first packer assembly 130 via the side conduit 16 such that the second interval 136 can be packed with the gravel slurry. The gravel slurry can enter the first openings 152, flow through the shunt tube 146, the side conduit 16, into the shunt tube 147, and out the openings 154.

Similarly, the second packer assembly 138 can include the isolation valve assembly 1 (FIGS. 1A-2) and, accordingly, side conduits 16, which can provide a similar bypass route for fluidly connecting the shunt tubes 147, 148 together, the shunt tubes 150, 151 together, and/or connecting other shunt tubes together (not shown) thereby allowing fluid communication between the second and third intervals 136, 140. Furthermore, in various embodiments, one, some, or a majority of the shunt tubes 146-151 can be omitted. For example, if the shunt tubes 146, 147 are omitted, the side conduit 16 of the first packer assembly 130 can open up into the first and second intervals 128, 136, allowing free flow of gravel slurry between the first and second intervals 128, 136. It will be appreciated that any configuration of shunt tubes 146-151 and side conduits 16 is within the scope of this disclosure; for example, some shunt tubes 146-151 may not connect to side conduits 16, and some side conduits 16 may not connect to shunt tubes 146-151.

In one or more embodiments, a valve shifting tool 200 can be disposed "below" the one or more isolation valve assemblies 158, 160. The valve shifting tool 200 can be actuated by pulling the valve shifting tool 200 toward the isolation valve assemblies 158, 160 in any manner, for example, using a mandrel or another downhole tool which can mechanically, magnetically, hydraulically, pneumatically or otherwise engage the valve shifting tool 200 and pull the valve shifting tool 200. In one or more embodiments, the valve shifting tool 200 can also or instead be moved or actuated by other forces, such as by pressure differentials in the production tubing 3 or the like.

With additional reference to FIGS. 1A and 1B, in one or more embodiments, the valve shifting tool 200 can engage the isolation valve assemblies 158, 160 to actuate the isolation valve assemblies 158, 160, thereby isolating the first-third intervals 128, 136, 140 from each other. In one or more embodiments, when the valve shifting tool 200 is pulled toward to a position proximal one of the isolation valve assemblies 158, 160, an engagement profile 202 of the valve shifting tool 200 can engage the latch profile 34 of the internal sleeve 24 of the one of the isolation valve assemblies 158, 160, thereby moving the internal sleeve 24. Accordingly, the sliding sleeve 12 of the one of the isolation valve assemblies 158, 160 can be moved from the open to the closed position.

Once the internal sleeve 24 reaches its end range, the engagement profile 202 of the valve shifting tool 200 can disengage from the latch profile 34, and the valve shifting tool 200 can continue past the isolation valve assembly 158 or 160. Additionally, the closing movement of the sliding sleeve 12 of the isolation valve assemblies 158, 160 can be reversed, for example, by reversing the direction of the valve shifting tool 200. Furthermore, it will be appreciated that, in various other embodiments, one of the isolation valve assemblies 158, 160 can be a barrel valve and/or one or more of the isolation valve assemblies 158, 160 can be electrically, pneumatically, or hydraulically actuated, and thus may not require the valve shifting tool 200 to actuate.

In illustrative operation of the wellbore completion 100, the gravel slurry can be pumped down the first annulus 126 and communicated through line 144 of the crossover device 142 to the first interval 128. The first, second, and third intervals 128, 136, 140 can be then be filled with gravel in any order desired. In one or more embodiments, if the first interval 128 is blocked by bridging, further flow of the gravel slurry can be provided through the shunt tube 146, which can route the gravel slurry into openings 152 located above the obstruction (not shown), through a portion of the shunt tube 146, and out openings 152 located below the obstruction.

Once the first interval 128 is filled, the gravel slurry can flow through the shunt tubes 146, 149, through the side conduits 16 of the first packer assembly 130, and into the shunt tubes 147, 150 in the second interval 136. The gravel slurry can enter the second interval 136 through the openings 154 in the shunt tube 147 and/or through openings 156 in the shunt tube 150 to fill the second interval 136 with gravel. The gravel slurry can next flow farther down the wellbore completion 100, through the side conduits 16 of the second packer assembly 138, and into the third interval 140 via the shunt tubes 148, 151 to fill the third interval 140 with gravel. Once the first, second, and third intervals 128, 136, 140 and any other intervals present (not shown) have filled with gravel, "sand out" can occur, in which further pumping of gravel slurry into the intervals 128, 136, 140 is generally not advantageous or possible. Subsequently, additional processing can take place in the well, such as production of wellbore fluids, for example, hydrocarbon retrieved from the subterranean formations 106, 108, 110 via the perforations 118, 120, 122.

The first, second, and/or third intervals 128, 136, 140 can be isolated prior to, after, or during sand-out, fracturing, or other wellbore operations as desired, by the actuation of the isolation valve assemblies 1. This can block up to all of any fluids or particulate matter that would otherwise flow between intervals 128, 136, 140 through the side conduits 16. Accordingly, when the isolation valve assemblies 158, 160 are embodiments of the isolation valve assembly 1 (FIGS. 1A-2), and the sliding sleeves 12 thereof are in the closed position (FIG. 2), the isolation valve assembly 158 can completely isolate one of the first intervals 128 from the second interval 136, and the isolation valve assembly 160 can completely isolate the second interval 136 from the third interval 140, assuming no lack of integrity of the remaining components in the wellbore completion 100. As it is used herein, the term "completely isolating an interval" means that no or substantially no fluid is able to move into that interval from another interval.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A wellbore completion apparatus, comprising;

a conduit configured to extend between first and second wellbore intervals and through an isolation valve assembly separating the first and second intervals;

a sliding sleeve configured to slide between an open position and a closed position wherein the sliding sleeve in the open position is configured to allow a flow of gravel slurry through the conduit between the first and second intervals, and the sliding sleeve in the closed position is configured to block the flow of gravel slurry through the conduit to isolate the first and second intervals from each other;

an interval sleeve shiftably disposed in an inner bore of the isolation valve assembly and coupled to the sliding sleeve such that movement of the internal sleeve moves the sliding sleeve, offset first and second notches defined in the inner bore, wherein the internal sleeve further comprises:

a latch profile;

a collet region biased toward the inner bore and configured to resiliently deform; and a detent disposed on the collet region, the collet region configured to bias the detent into the first notch when the sliding sleeve is in the open position and to bias the detent into the second notch when the sliding sleeve is in the closed position; and a production tubing that is substantially parallel too the sliding sleeve, the production tubing configured to receive and to channel a wellbore production fluid from a subterranean formation and out of the wellbore; and a valve shifting tool disposed in the production tubing and configured to slide therein such that the valve shifting tool engages the internal sleeve and moves the sliding sleeve between the open and closed positions, wherein a tool comprises an engagement profile configured to releasably engage the latch profile such that the internal sleeve moves with the valve shifting tool.

2. The wellbore completion apparatus of claim 1, further comprising:

a first shunt tube connected to a first side of the conduit and having first openings defined therein, the first shunt tube configured to channel the flow of gravel slurry through the first interval and into the conduit; and a second shunt tube connected to a second side of the conduit and having second openings defined therein, the second shunt tube configured to receive the flow of gravel slurry from the conduit and channel the gravel slurry to the second interval.

3. The wellbore completion apparatus of claim 1, wherein the engagement profile of the valve shifting tool is configured to release from the latch profile of the internal sleeve.

4. An apparatus for gravel packing, comprising:

first and second shunt tubes;

an isolation valve assembly defining a conduit having a first side coupled to the first shunt tube and a second side coupled to the second tube, and cavity having length and intersecting with the conduit at an intersection, wherein the conduit has first and second angled portions terminating at the first and second sides, respectively, and a central portion connecting the two angled portions; and a sliding sleeve having a length that is shorter than the length of the cavity, the sliding sleeve defining an aperture therein, wherein the sliding sleeve is disposed at least partially in the cavity such that the sliding sleeve slides from an open position in which the aperture is aligned with the intersection of the cavity and the conduit to allow fluid communication through the conduit, and a closed position in which the sliding sleeve spans the intersection of the cavity and the conduit to sealingly obstruct the conduit, and wherein the cavity extends substantially parallel to the central portion of the conduit and intersects one or both of the first and second angled portions, such that when the sleeve is in the closed position, the sleeve spans one or both of the first and second angled portions.

5. The apparatus of claim 4, wherein the sliding sleeve is sealingly received in the cavity in the open and closed positions.

6. An apparatus for gravel packing, comprising:

first and second shunt tubes;

an isolation valve assembly defining a conduit having a first side coupled to the first shunt tube and a second side coupled to the second shunt tube, and a cavity having a length and intersecting with the conduit at an intersection;

a production tubing through the isolation valve assembly, wherein at least a portion of the first and second shunt tubes extend substantially parallel to a central axis of the production tubing;

a valve shifting tool having an engagement profile and configured to slide in the production tubing;

a sliding sleeve having a length that is shorter than the length of the cavity, the sliding sleeve defining an aperture therein, wherein the sliding sleeve is disposed at least partially in the cavity such that the sliding sleeve slides from an open position in which the aperture is aligned with the intersection of the cavity and the conduit to allow fluid communication through the conduit, and a closed position in which the sliding sleeve spans the intersection of the cavity and the conduit to sealingly obstruct the conduit;

an internal sleeve disposed in an inner bore of the isolation valve assembly, connected to the sliding sleeve, and having a bi-directional latch profile configured to releasably engage the engagement profile of the valve shifting tool to shift the internal sleeve;

a translation key connecting the internal sleeve and the sliding sleeve together;

a first notch defined in the inner bore;

a second notch defined in the inner bore and axially offset from the first notch;

a collet region biased inward the inner bore and configured to resiliently deform; and a detent disposed on the collet region, the collet region configured to bias the detent into the first notch when the sliding sleeve is in the open position and to bias the detent into the second notch when the sliding sleeve is in the closed position.

* * * * *